US009790677B2

(12) United States Patent
Hashimoto et al.

(10) Patent No.: US 9,790,677 B2
(45) Date of Patent: Oct. 17, 2017

(54) REMOTE CONTROL DEVICE

(71) Applicant: TOTO, Ltd., Kitakyushu-shi, Fukuoka (JP)

(72) Inventors: Shingo Hashimoto, Kitakyushu (JP); Takashi Maeno, Kitakyushu (JP); Daisuke Hayashida, Kitakyushu (JP)

(73) Assignee: TOTO, Ltd., Kitakyushu-shi, Fukuoka (JP)

( * ) Notice: Subject to any disclaimer, the term of this patent is extended or adjusted under 35 U.S.C. 154(b) by 182 days.

(21) Appl. No.: 14/633,922

(22) Filed: Feb. 27, 2015

(65) Prior Publication Data

US 2015/0252557 A1 Sep. 10, 2015

(30) Foreign Application Priority Data

Mar. 6, 2014 (JP) ..... 2014-043730

(51) Int. Cl.
*G08C 17/00* (2006.01)
*E03D 5/10* (2006.01)
*E03D 9/08* (2006.01)

(52) U.S. Cl.
CPC ..... *E03D 9/08* (2013.01); *E03D 5/10* (2013.01); *G08C 17/00* (2013.01); *G08C 2201/112* (2013.01)

(58) Field of Classification Search
CPC ..... E03D 9/08; E03D 5/10; G08C 17/00
See application file for complete search history.

(56) References Cited

U.S. PATENT DOCUMENTS

2002/0190610 A1 12/2002 Andre et al.
2015/0234371 A1* 8/2015 Morioka ..... E03D 9/08 4/448

FOREIGN PATENT DOCUMENTS

JP H11071799 A 3/1999
JP 2005-245115 A 9/2005
JP 2006009280 A * 1/2006

OTHER PUBLICATIONS

Jul. 8, 2015—(EP) Search Report—App 15155735.2.

* cited by examiner

*Primary Examiner* — Tuan N Nguyen
(74) *Attorney, Agent, or Firm* — Banner & Witcoff, Ltd.

(57) ABSTRACT

A remote control device for remotely controlling a toilet device is provided. The remote control device includes a casing, a power generation device, buttons, and a link mechanism. The casing forms a contour of the remote control device. The power generation device is housed in the casing and is capable of generating a power by being pressed. The buttons is provided on a surface of the casing and each is configured to activate a function of the toilet device. The link mechanism is configured to move so as to press the power generation device when one of the buttons is pressed. The buttons is supported on the casing by an elastic member so that, when one of the buttons is pressed to cause motion of the link mechanism, one other of the buttons not pressed is not affected by the motion of the link mechanism.

5 Claims, 7 Drawing Sheets

REMOTE CONTROL DEVICE

CROSS-REFERENCE TO RELATED APPLICATIONS

This application is based upon and claims the benefit of priority from Japanese Patent Application No. 2014-043730, filed on Mar. 6, 2014; the entire contents of which are incorporated herein by reference.

FIELD

Embodiments described herein relate generally to a remote control device including a plurality of buttons for remotely controlling a toilet device.

BACKGROUND

Toilet seat devices for jetting water toward the private parts of a user seated on a toilet seat are widely used for the purpose of washing the private parts. After using the toilet, the user causes the toilet seat device to perform operations such as jetting water from the nozzle and stopping the jetting after washing. The user selects such operations by pushing buttons or the like of a remote control device installed in the space in which the toilet seat device is provided. The buttons are often placed at a location where the user can easily push them. To this end, a remote control device including the buttons is typically installed on the wall surface or the like of the toilet booth. The toilet seat device is remotely controlled in a wireless manner.

Thus, the operation of the toilet seat device may be selected by a remote control device. This requires electric power for generating a signal corresponding to the selected option and transmitting the signal to the toilet seat device. The power is typically supplied from a battery incorporated in the remote control device or from the commercial power source through a wire. However, power supply by a battery or wire is cumbersome because it needs battery exchange or wiring work.

Japanese Unexamined Patent Publication 2006-9280 proposes a remote control device for a toilet seat device dispensing with such battery exchange and wiring work. In the remote control device disclosed in JP 2006-9280, when a user pushes a button of the remote control device, electric power is generated by the push operation and used to generate and transmit a signal. Specifically, the push operation of the user is used to drive a mechanism such as a button body and a locking piece part provided inside the remote control device, and applies impact to a piezoelectric ceramic body. The power generated accordingly is used for signal generation and the like.

The remote control device disclosed in JP 2006-9280 includes a plurality of buttons on a panel section. In the structure of this remote control device, the entire panel section is pressed to the rear surface side of the remote control device so that the mechanism such as a button body and a locking piece part can be driven by pushing any of the buttons. Self-power generation is performed by the pressing force. Here, self-power generation by pushing a certain button requires moving the entire panel section. The problem is that the need of moving the entire panel section requires large force for pushing the button, which is inconvenient for the user.

SUMMARY

According to one embodiment, a remote control device for remotely controlling a toilet device is provided. The remote control device includes a casing, a power generation device, a plurality of buttons, and a link mechanism. The casing forms a contour of the remote control device. The power generation device is housed in the casing and is capable of generating a power by being pressed. The buttons is provided on a surface of the casing and each is configured to activate a function of the toilet device. The link mechanism is configured to move so as to press the power generation device when one of the buttons is pressed. The buttons is supported on the casing by an elastic member so that, when one of the buttons is pressed to cause motion of the link mechanism, one other of the buttons not pressed is not affected by the motion of the link mechanism.

DETAILED DESCRIPTION

Figure 1:
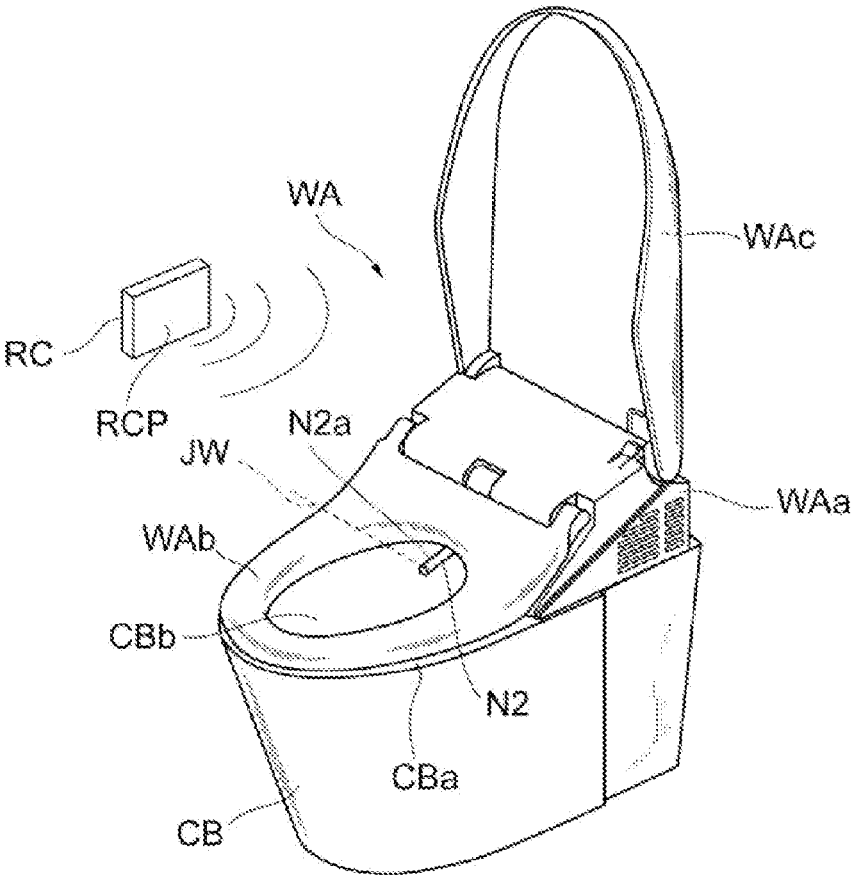
FIG. 1 is a perspective view showing a remote control device and a toilet seat device according to the embodiment of the invention.

An aspect of the invention is a remote control device for remotely controlling a toilet device. The remote control device comprises a casing forming a contour of the remote control device, a power generation device housed in the casing and being capable of generating a power by being pressed, a plurality of buttons provided on a surface of the casing and each configured to activate a function of the toilet device, and a link mechanism configured to move so as to press the power generation device when one of the buttons is pressed. The buttons are supported on the casing by an elastic member so that, when one of the buttons is pressed to cause motion of the link mechanism, one other of the buttons not pressed is not affected by the motion of the link mechanism.

In the aspect of the invention thus configured, the buttons are supported by the elastic member without being affected by the motion of the link mechanism. Thus, even when one of the buttons is pushed to move the link mechanism, the other buttons are not moved in an interlocked manner. Accordingly, no excess pressing force is required when pushing a button. Thus, the remote control device provides good operability for the user.

An alternative aspect of the invention is a remote control device further comprising a plurality of pushing parts provided on each of the buttons and configured to push the link mechanism, and a plurality of receptacles provided on the link mechanism and configured to engage with each of the pushing parts. The pushing part of the pushed one of the buttons pushes the receptacle and moves the link mechanism.

In the aspect of the invention thus configured, the pushing part engages with the receptacle. Accordingly, even when one of the buttons is pushed to move the link mechanism, the other buttons are reliably prevented from moving in an interlocked manner. Thus, the remote control device provides good operability for the user.

An alternative aspect of the invention is a remote control device, wherein each of the pushing parts is shaped like a protrusion, and each of the receptacles includes a depression configured to engage with one of the pushing parts. When one of the pushing parts engages with one of the depressions, the other pushing parts do not engage with the other depressions.

In the aspect of the invention thus configured, when the user pushes a button, the pushing part is pushed down. The pushing part is brought into contact with the depression and pushes the depression. Thus, the link mechanism moves in a prescribed direction. Accordingly, the link mechanism can be moved with a simple structure.

An alternative aspect of the invention is a remote control device, wherein the pushing part includes a first protruding part extending toward the receptacle, and the receptacle includes a second protruding part extending opposite to the first protruding part. A first slope surface and a second slope surface are formed opposite to each other on opposed surfaces of the first protruding part and the second protruding part.

In the aspect of the invention thus configured, when the user pushes a button, the pushing part is pushed. The first protruding part is brought into contact with the second protruding part. Accordingly, the second protruding part moves along the slope surface. Thus, the link mechanism also moves in a prescribed direction. Accordingly, the link mechanism can be moved with a simple structure.

An alternative aspect of the invention is a remote control device, wherein the power generation device includes an input part capable of self-power generation by being pressed by the link mechanism, and a stopper part configured to physically regulate a position of the link mechanism.

In the aspect of the invention thus configured, the power generation device includes a stopper part. Thus, the motion of the link mechanism does not stop elsewhere, but is stopped by the stopper part. Thus, the power generation device can reliably generate power.

Embodiments of the invention will now be described with reference to the accompanying drawings. To facilitate understanding, like components in the drawings are labeled with like reference numerals wherever possible, and the duplicated description is omitted.

First, the usage state of a remote control device according to an embodiment of the invention is described with reference to FIG. 1. FIG. 1 is a perspective view showing a remote control device and a toilet seat device according to the embodiment of the invention. In this specification, the panel of the remote control device RC where the user pushes the buttons SB, MB is referred to as front surface side, and the opposite side is referred to as rear surface side. In this invention, the toilet device refers to e.g. a toilet seat device WA placed on the upper surface of the closet bowl CB, a water supply device for supplying water for the closet bowl CB, and an air conditioning device placed in the toilet room.

The toilet seat device WA is mounted on the rim CBa of the closet bowl CB. The toilet seat device WA includes a main section WAa, a toilet seat WAb, and a cover WAc. The main section WAa includes therein e.g. an electric component and a water supply mechanism. The main section WAa includes a nozzle N2. The nozzle N2 can be advanced and retracted with respect to the bowl section CBb of the closet bowl CB. The nozzle N2 is shaped like a circular cylinder. A nozzle hole N2*a* is formed in the upper surface of the nozzle N2. In the state of being advanced into the bowl section CBb, the nozzle N2 is supplied with water from the water supply mechanism. Thus, the nozzle N2 jets water as a jet flow JW from the nozzle hole N2*a* toward the user's private parts. The user is seated on the toilet seat WAb when using the toilet. The toilet seat WAb is rotatably pivoted on the main section WAa. When not in use, the toilet seat WAb is covered from above with the cover WAc. The cover WAc is also rotatably pivoted on the main section WAa.

The remote control device RC includes a plurality of buttons SB, MB for remotely controlling the toilet seat device WA. The remote control device RC is fixed to e.g. the wall surface of a toilet booth in which the closet bowl CB and the toilet seat device WA are placed. The remote control device RC is provided so that the panel RCP thereof is opposed toward the toilet seat device WA. The user uses the panel RCP to select an operation to be performed by the toilet seat device WA. Thus, the user remotely controls the toilet seat device WA. Specifically, the remote control device RC generates a radio frequency signal based on the option selected by the user on the panel RCP. The remote control device RC wirelessly transmits the radio frequency signal toward the toilet seat device WA. The toilet seat device WA receives this radio frequency signal in the reception section incorporated in the main section WAa. Based on the content of the signal, for instance, the toilet seat device WA jets or stops water from the nozzle N2, adjusts the water pressure of jet water, and changes the position of the nozzle N2.

Figure 2:
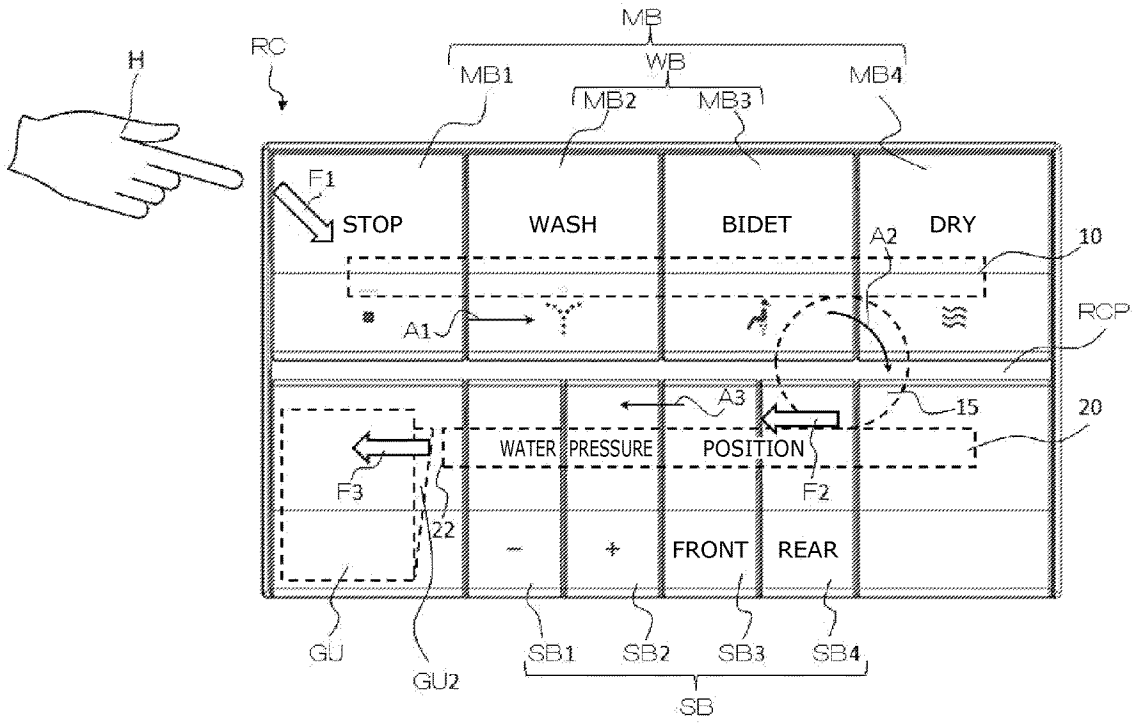
FIG. 2 is a front view showing the remote control device according to the embodiment of the invention.

Next, the panel of the remote control device according to the embodiment of the invention is described with reference to FIG. 2. FIG. 2 is a front view showing the remote control device according to the embodiment of the invention.

As shown in FIG. 2, the panel RCP of the remote control device RC includes a second casing 60 described later, a main button group MB arranged on the upper side, and a sub button group SB arranged below the main button group MB.

The main button group MB consists of a stop button MB1, a jet button WB, and a dry button MB4. Furthermore, the jet button WB consists of a bottom wash button MB2 and a bidet wash button MB3. These four buttons each have a generally square shape in front view. The four buttons are arranged generally linearly in the width direction of the remote control device RC. The jet button WB is a button to be pushed in causing an operation of jetting from the nozzle N2. When the bottom wash button MB2 is pushed, water is jetted toward the user's anus. When the bidet wash button MB3 is pushed, water is jetted toward the woman's private parts. The dry button MB4 is a button to be pushed in causing a drying operation after washing the private parts. In the drying operation, warm air is blown out from a fan incorporated in the main section WAa toward the private parts. The stop button MB1 is a button to be pushed in stopping the jetting operation and the drying operation described above.

The sub button group SB consists of a minus button SB1, a plus button SB2, a front button SB3, and a rear button SB4. These four buttons each have a rectangular shape smaller than each button of the main button group MB in front view. The four buttons are arranged generally linearly in the width direction of the remote control device RC. The minus button SB1 and the plus button SB2 are buttons to be pushed by the user in changing the water pressure of jetting water from the nozzle N2 in accordance with the user's preference. The front button SB3 and the rear button SB4 are buttons to be pushed by the user in changing the position of the nozzle N2 in accordance with the position of the user's private parts. As described above, the buttons are configured in two rows. That is, the main button group MB is placed on the upper row, and the sub button group SB is placed on the lower row.

As indicated by dashed lines in FIG. 2, a first slide member 10, a second slide member 20, and a gear 15 are incorporated on the rear surface side of the main button group MB and the sub button group SB. The first slide member 10 is a first link member and extends in the width direction of the remote control device RC. The second slide member 20 is a second link member. The gear 15 transmits the motion of the first slide member 10 to the second slide member 20, and the motion of the second slide member 20 to the first slide member 10. The gear 15 is a transmission means such that the motion of one of the first slide member 10 and the second slide member 20 results in the motion of the other member in an interlocked manner. Furthermore, a power generation unit GU is incorporated below the first slide member 10 and lateral to the second slide member. The power generation unit GU is a power generation device capable of self-power generation by being pressed. The power generation unit GU, the first slide member 10, and the second slide member 20 are housed inside the first casing 50 and the second casing 60 described later.

Figure 3:
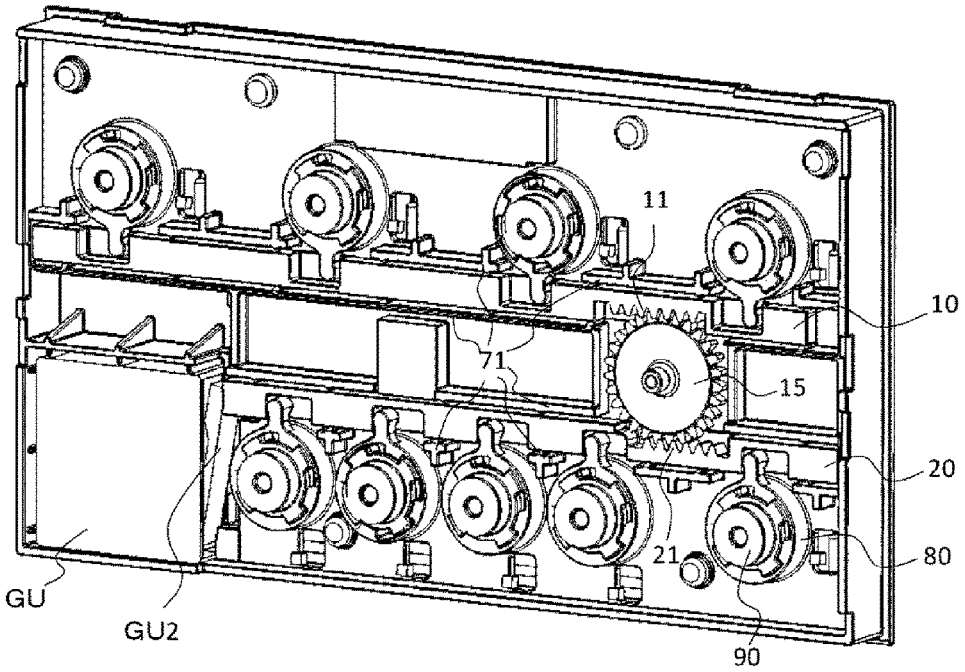
FIG. 3 is a perspective view showing an internal structure of the remote control device according to the embodiment of the invention.

As shown in FIG. 3, the gear 15 is a toothed wheel and placed between the first slide member 10 and the second slide member 20. The first slide member 10 includes a first rack 11 for mating with the teeth of the gear 15. The second slide member 20 includes a second rack 21 for mating with the teeth of the gear 15.

The first slide member 10 is configured to slide in the direction of arrow A1 when one button of the main button group MB is pushed. For instance, the stop button MB1 is pushed with force F1 by the user's finger H. The first slide member 10 slides in the direction of arrow A1. Then, the gear 15 rotates clockwise (in the direction of arrow A2) and transmits force F2 to the second slide member 20. Upon receiving this force F2, the second slide member 20 slides in the direction of arrow A3 antiparallel to arrow A1.

On the other hand, the second slide member 20 is configured to slide in the direction of arrow A2 when one button of the sub button group SB is pushed. In this case, the second slide member 20 rotates the gear 15 clockwise. Thus, the first slide member 10 slides in the direction of arrow A1. Accordingly, the first slide member 10 and the second slide member 20 both slide when any button SB, MB is pressed irrespective of the main button group MB or the sub button group SB. Thus, the pressing forces of the buttons SB, MB are nearly equal. This provides a remote control device having good operability with the same pressing force for any button SB, MB.

Thus, the second slide member 20 slides in the direction of arrow A2 when one button SB, MB of the main button group MB or the sub button group SB is pushed. Then, the input part GU2 of the power generation unit GU is pushed in with force F3 by the end part 22 of the second slide member 20. The electric component necessary for power generation of the power generation unit GU is housed in a generally rectangular casing. The input part GU2 is pivotally supported on the end part of one side of the casing of the power generation unit GU and placed outside the casing. By being pressed, the input part GU2 is pushed into the casing of the power generation unit GU. The power generation unit GU generates power by this mechanical energy inputted from the input part GU2.

Figure 4:
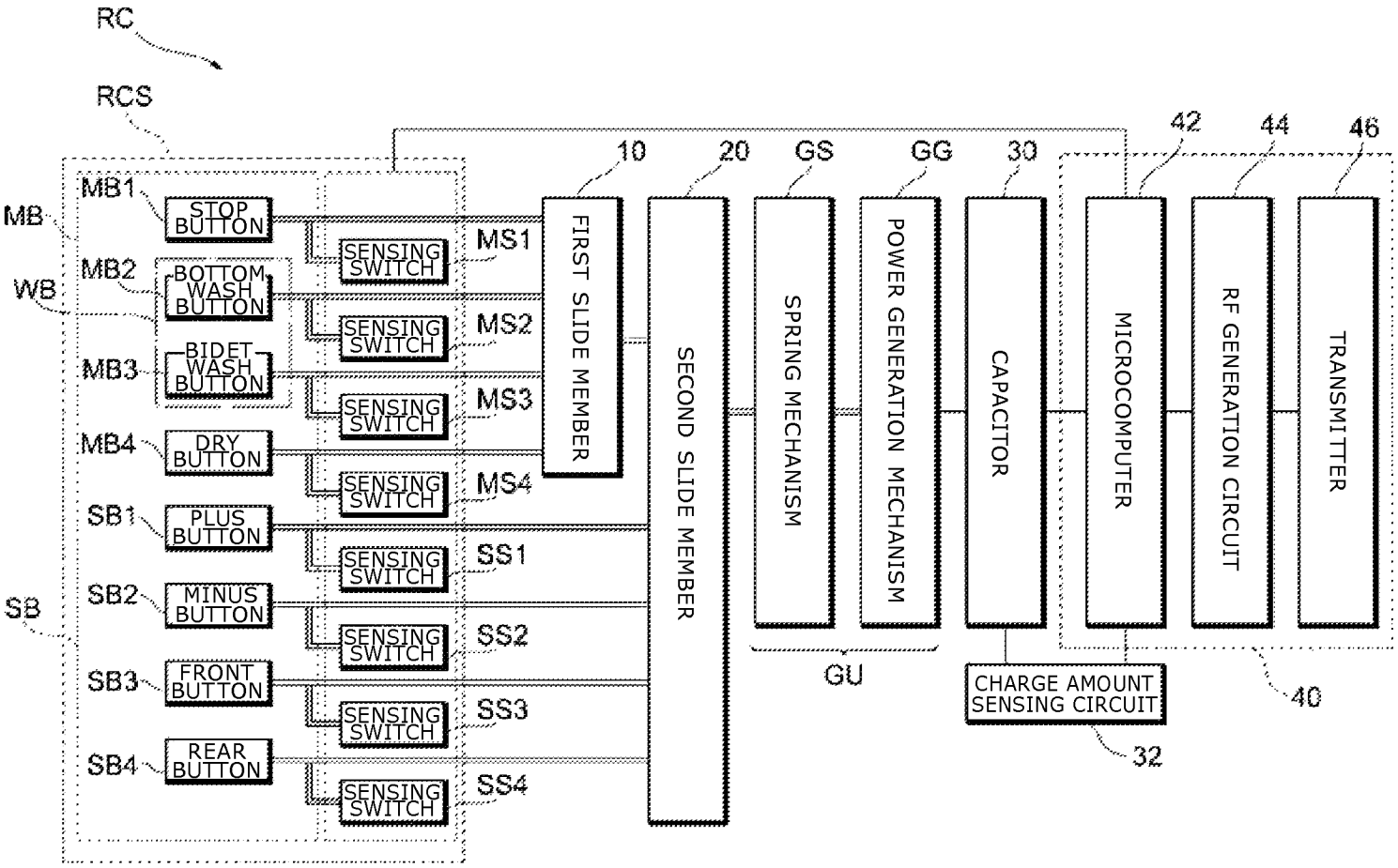
FIG. 4 is a block diagram showing the remote control device according to the embodiment of the invention.
Figure 5:
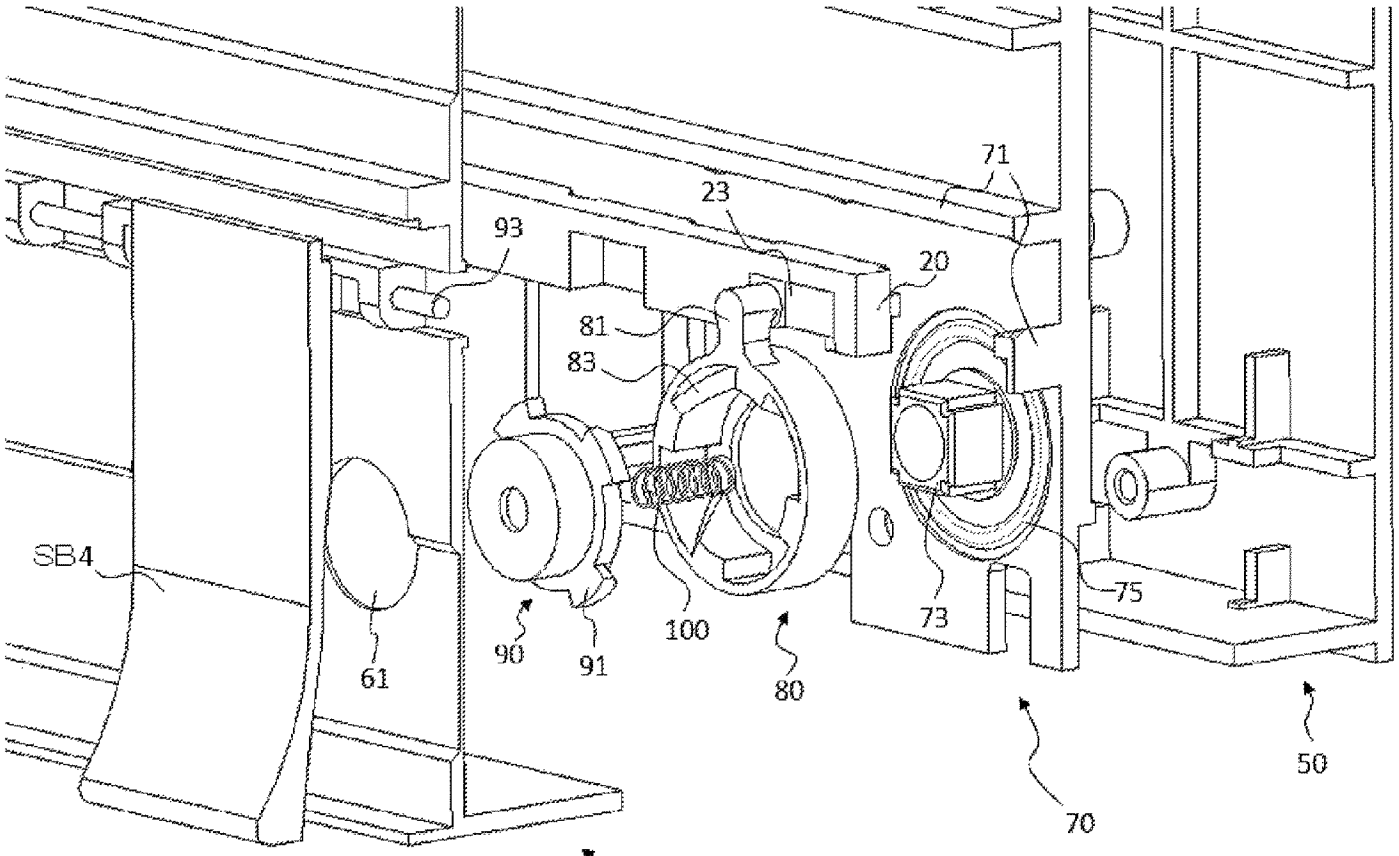
FIG. 5 is an exploded perspective view showing a part of the remote control device according to the embodiment of the invention.

Next, the mechanical configuration and the electrical configuration of the remote control device according to the embodiment of the invention are described with reference to FIG. 4. FIG. 4 is a block diagram showing the remote control device according to the embodiment of the invention.

As described above, one button SB, MB of the main button group MB or the sub button group SB is pushed by a user. Then, the force is transmitted to the gear 15 through the first slide member 10, and transmitted to the second slide member 20 through the gear 15. The second slide member 20 is slid by the transmitted force. Thus, the second slide member 20 further transmits the force to the power generation unit GU.

The power generation unit GU includes a spring mechanism GS and a power generation mechanism GG. The power generation mechanism GG generates power by converting the mechanical energy inputted from the second slide member 20 to electrical energy. The spring mechanism GS is configured to restore the input part GU2 to the original position after the input part GU2 is pushed into the power generation unit GU by the second slide member 20. Specifically, when the user pushes a button SB, MB, the input part GU2 is pushed in. This contracts the spring of the spring mechanism GS provided on the input part GU2. Then, when the user stops pressing the button SB, MB, the spring is released. Thus, the input part GU2 returns to the original position. Accordingly, the second slide member 20 returns to the original position by the input part GU2. In response, the gear 15 rotates. Thus, the first slide member also returns to the original position.

The power generated by the power generation unit GU is supplied to a capacitor 30. The capacitor 30 stores the supplied power.

A control unit 40 is connected to the output terminal of the capacitor 30. The control unit 40 includes a microcomputer 42, a radio frequency generation circuit 44, and a transmitter 46. The microcomputer 42 is activated by receiving power supply from the capacitor 30 and controls the radio frequency generation circuit 44 and the transmitter 46. A charge amount sensing circuit 32 is connected to the capacitor 30. The microcomputer 42 is configured to wait activation until the charge amount sensing circuit 32 senses that the power stored in the capacitor 30 becomes more than or equal to a reference amount. Specifically, the charge amount sensing circuit 32 senses the stored power based on the voltage of the capacitor 30.

Sensing switches MS1-MS4, SS1-SS4 are connected respectively to the corresponding buttons SB, MB of the main button group MB and the sub button group SB. These sensing switches are each a switch for sensing that the corresponding button SB, MB has been pushed by a user.

When one button SB, MB of the main button group MB or the sub button group SB is pushed, the power stored in the capacitor 30 becomes more than or equal to the reference amount. Then, the microcomputer 42 is activated by receiving power supply from the capacitor 30. The microcomputer 42 acquires information from the sensing switches (as to which button SB, MB has been pushed). Thus, the microcomputer 42 causes the radio frequency generation circuit 44 to generate a radio frequency signal corresponding to the acquired information. Then, the microcomputer 42 causes the transmitter 46 to transmit it toward the toilet seat device WA.

Next, the internal structure of the remote control device RC and the push operation on each button SB, MB are described with reference to FIGS. 5 to 7B.

The contour of the remote control device RC is formed by covering a first casing 50 with a second casing 60. The first casing 50 is shaped like a box with the front being open. Furthermore, buttons SB, MB are attached to the second casing 60. The buttons SB, MB can be pushed toward the rear surface of the remote control device RC.

A partition plate 70 is provided inside the first casing 50. The partition plate 70 separates the rear surface side and the front surface side of the first casing 50. In other words, the partition plate 70 is provided so as to cover the plate member on the rear surface side of the first casing 50 with a prescribed distance spaced from the plate member. A rotary member 80, a non-rotary member 90, and a spring 100 are placed between the partition plate 70 and the second casing 60.

A standing wall 71 is placed on the partition plate 70. The standing wall 71 is erected toward the front surface side of the remote control device RC and supports the first slide member 10 and the second slide member 20. The standing wall 71 regulates the vertical motion of the first slide member 10 and the second slide member 20 and allows them to slide horizontally.

The partition plate 70 is provided with a fitting member 73 in which the non-rotary member 90 described later is fitted. The fitting member 73 is a member shaped like a rectangular prism projected from the partition plate 70.

The partition plate 70 includes a circular groove part 75 for positioning the rotary member 80 described later. A plurality of rotary members 80 are placed on the rear surface side of the plurality of buttons SB, MB.

Figure 6:
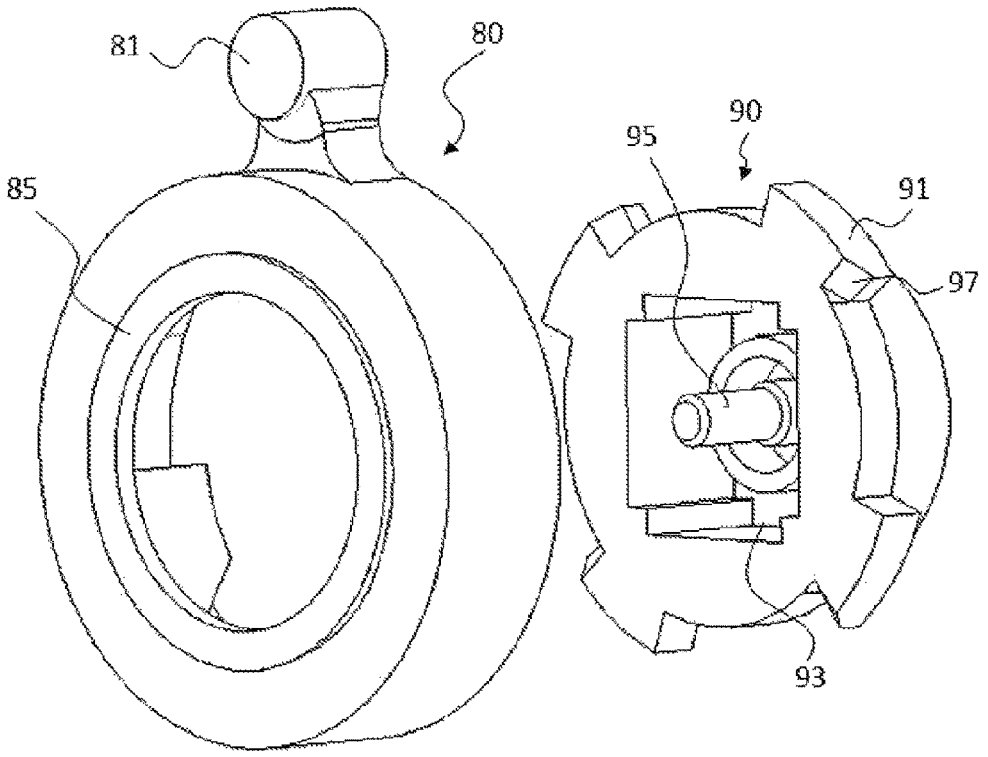
FIG. 6 is a perspective view showing a non-rotary member of the remote control device according to the embodiment of the invention.

The rotary member 80 is shaped like a circular cylinder. A pushing part 81 shaped like a protrusion is formed on the outer peripheral surface of the rotary member 80. The pushing part 81 is configured to push a depression 23 provided as a receptacle on the first slide member 10 or the second slide member 20. Four slope parts 83 are projected from the inner peripheral surface of the rotary member 80. The slope part 83 has a slope surface in the rotation direction of the rotary member 80. The slope parts 83 are equally spaced on the inner peripheral surface. Furthermore, as shown in FIG. 6, a guide part 85 is provided on the rear surface of the rotary member 80 so as to fit into the groove part 75.

The non-rotary member 90 is spaced from the front surface side of the rotary member 80 so that the linear motion of the button SB, MB pressed by a user is transmitted to the rotary member 80. The non-rotary member 90 is supported by a spring 100. The spring 100 is an elastic member attached to the partition plate 70. The non-rotary member 90 has a circular shape. The non-rotary member 90 has a smaller outer peripheral surface and a larger outer peripheral surface. Four protruding parts 91 are formed at equal spacings from the larger outer peripheral surface. As shown in FIG. 6, a rectangular hole 93 for fitting with the fitting member 73 is provided on the rear surface side of the non-rotary member 90. A spring shaft 95 inserted into the spring is formed from the center of the rectangular hole 93. The fitting member 73 projected from the partition plate 70 is inserted into the rectangular hole 93. This regulates the rotational motion about the direction in which the button SB, MB is pressed. A slope guide part 97 shaped like a slope surface is formed on the surface of the protruding part 91 opposed to the slope part 83 so that the non-rotary member 90 is smoothly pushed into the rotary member 80.

Next, a method for assembling the remote control device RC is described. First, a substrate (not shown) with electronic components mounted thereon is attached to the first casing 50. Next, the partition plate 70 is attached so as to cover the first casing 50. After the partition plate 70 is attached, the first slide member 10 and the second slide member 20 are inserted into the gap of the standing wall 71 of the partition plate 70. Then, the gear 15 is attached between the slide members. Next, the guide part 85 of the rotary member 80 is inserted into the groove part 75 of the partition plate 70 for each position of the plurality of buttons SB, MB. On the other hand, the spring shaft 95 of the non-rotary member 90 is inserted into the spring 100. Then, the non-rotary member 90 is pushed into the rotary member 80. Next, the second casing 60 covering the partition plate 70 is attached to the first casing 50. The second casing 60 is provided with a hole 61. The hole 61 is larger than the outer shape of the front surface side of the non-rotary member 90. The hole 61 is smaller than the outer shape of the protruding part 91 on the rear surface side having an outer shape larger than the outer shape of the front surface side. The hole 61 prevents the non-rotary member 90 from jumping out by the spring 100. Finally, the buttons SB, MB are rotatably attached to the shaft 93 formed on the second casing 60. The buttons SB, MB are thus rotatably attached so that the non-rotary member 90 can be pushed to the rear surface side by pressing the buttons SB, MB.

In the above configuration, a plurality of buttons SB, MB are supported by the spring 100 on the first casing 50. Thus, even when one of the plurality of buttons SB, MB is pushed to move the link mechanism, the buttons other than the pushed button SB, MB are not moved in an interlocked manner. Accordingly, no excess pressing force is required when pushing a button SB, MB. Thus, the remote control device provides good operability for the user. Furthermore, when the button SB, MB is pressed by a user, the pushing part 81 is pushed down. The pushing part 81 is brought into contact with the depression 23 and pushes the depression 23. Thus, the link mechanism moves in a prescribed direction. Accordingly, the link mechanism can be moved with a simple structure. At this time, the pushing parts 81 other than the pushing part 81 in contact with the depression 23 are not brought into contact with the corresponding depression 23.

Figure 7A:
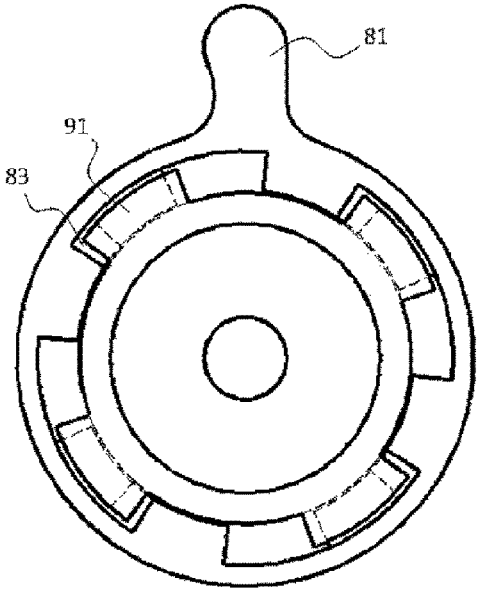
FIGS. 7A and 7B are front views showing a motion of a switch of the remote control device according to the embodiment of the invention.
Figure 7B:
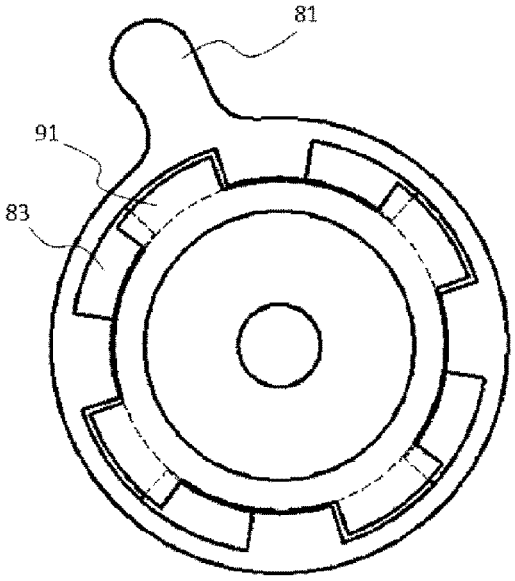

Next, a method for generating power in response to one button SB, MB being pressed by a user is described with reference to FIGS. 7A and 7B. As shown in FIG. 7A, when the plurality of buttons SB, MB are not pushed, the non-rotary member 90 is placed at a position nearly overlapping the slope part 83 of the rotary member 80. For instance, a user pushes the rear button SB4 to retract the position of the nozzle N2. Then, the rear button SB4 is rotated about the shaft 93 provided on the second casing 60 and moves the non-rotary member 90 to the rear surface side of the remote control device RC. The button SB4 is further pushed in, and the non-rotary member 90 is pushed to the rear surface side. Then, the non-rotary member 90 abuts on the bottom surface on the rear surface side of the rotary member 80. When the non-rotary member 90 is pushed out to the rear surface side, the protruding part 91 of the non-rotary member 90 is brought into contact with the slope part 83 of the rotary member 80. This pushes the slope part 83 and rotates the rotary member 80 counterclockwise in front view. That is, when the button SB, MB is pressed, the rotary member 80 undergoes a rotary motion in the plane perpendicular to the pressing direction. Then, as shown in FIG. 7B, the positional relationship between the protruding part 91 of the non-rotary member 90 and the slope part 83 of the rotary member 80 becomes nearly non-overlapping because of the rotation of the rotary member 80. The non-rotary member 90 moves to the rear surface side of the remote control device RC, and the rotary member 80 is rotated. Thus, the pushing part 81 is rotated. Accordingly, the second slide member moves horizontally via the depression 23 engaging with the pushing part 81. The input part GU2 of the power generation unit GU is pushed in by the end part 22 of the second slide member 20. That is, the remote control device RC generates power when the power generation unit GU is pressed by the linear motion of the second slide member.

The second slide member 20 is placed so as to abut on the contour of the casing of the power generation unit GU when the second slide member 20 is pushed in most deeply to the power generation unit GU side. That is, the contour of the casing of the power generation unit GU serves as a stopper part. The input part GU2 is pushed into the power generation unit GU so that the second slide member 20 abuts on the contour of the casing of the power generation unit GU. In other words, the stopper part physically regulates the slide position of the second slide member 20.

In the configuration of the remote control device RC described above, the power generation unit GU includes a stopper part. Thus, the motion of the first slide member 10 or the second slide member 20 does not stop elsewhere, but is stopped by the stopper part of the power generation unit GU. Thus, the power generation unit GU can reliably generate power.

Next, an alternative embodiment of the invention is described. In the alternative embodiment, instead of the rotary member 80 and the non-rotary member 90, a protrusion is provided on the rear surface of the button SB, MB. The protrusion is directly brought into contact with the first slide member 10 or the second slide member 20 to slide it in a prescribed direction.

Figure 8A:
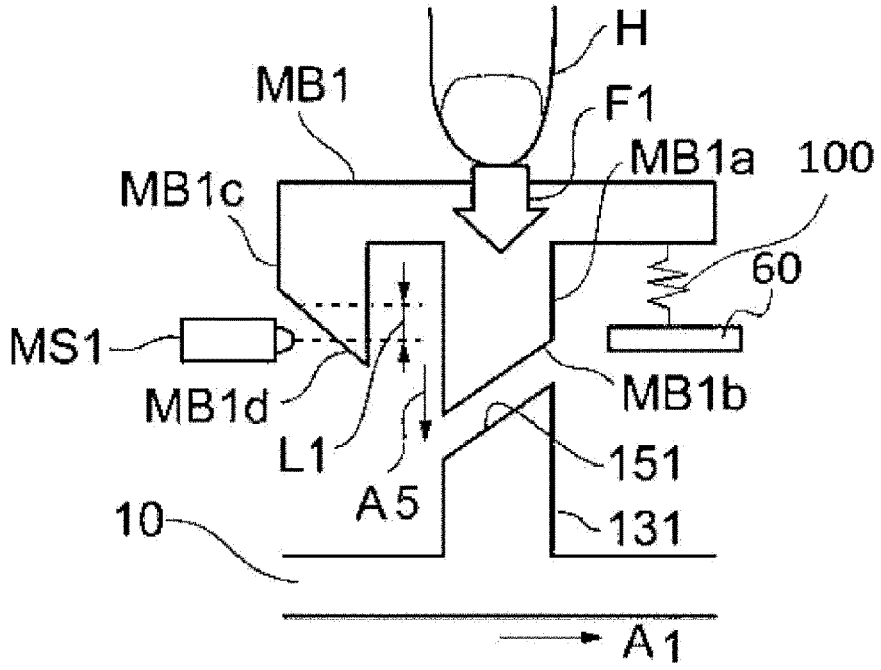
FIGS. 8A and 8B are schematic views showing bottom view of the switch of the remote control device according to the variation of the invention.
Figure 8B:
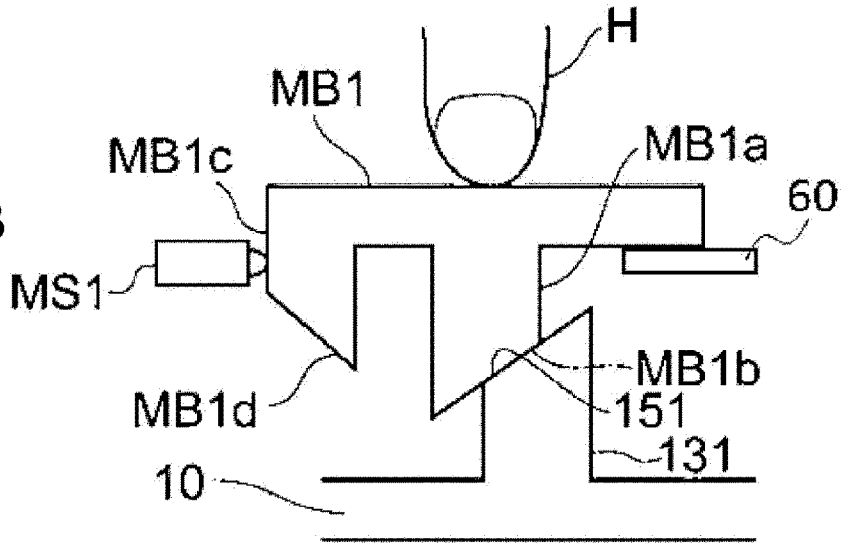

Specifically, as shown in FIGS. 8A and 8B, the stop button MB1 has a central protrusion MB1*a* at the center of its rear surface. The central protrusion MB1*a* is a first protruding part extending toward the first slide member 10 side. On the other hand, the first slide member 10 has a protrusion 131. The protrusion 131 is a second protruding part extending opposite to the central protrusion MB1*a*. A slope surface MB1*b* and a slope surface 151 are formed on the respective opposed surfaces. Furthermore, the stop button MB1 has a lateral protrusion MB1*c* on the lateral part of its rear surface. The lateral protrusion MB1*c* extends toward the first slide member 10 side. A slope surface MB1*d* is formed also on the end part on the rear surface side of the lateral protrusion MB1*c*. Furthermore, a sensing switch MS1 is placed at a position spaced by distance L1 from this slope surface MB1*d* to the rear surface side. The stop button MB1 is supported by a spring 100 attached to the second casing 60.

Force F1 is applied to the stop button MB1 by the user's finger H. Then, the stop button MB1 is pushed in the direction of arrow A5. As a result, the slope surface MB1*b* of the stop button MB1 abuts on the slope surface 151 of the first slide member 10. Then, the first slide member 10 starts sliding in the direction of arrow A1 by the force received on the slope surface MB1*d*.

The stop button MB1 is pushed in by the amount of L1 in the direction of arrow A5. Then, the sensing switch MS1 is pushed by the slope surface MB1*d* of the lateral protrusion MB1*c*. This enables sensing that the stop button MB1 has been pushed.

Then, the user can push the stop button MB1 so that the stop button MB1 abuts on the second casing 60 (FIG. 8B). That is, the sensing switch MS1 is configured so as to be able to sense that the stop button MB1 has been pushed before the stop button MB1 reaches the deepest position. Upon removing the force F1 applied to the stop button MB1 by the user's finger H, the contracted spring 100 is released. Thus, the stop button MB1 returns to the original position (FIG. 8A).

In this configuration, the central protrusion MB1*a* is brought into contact with the protrusion 131, and the first slide member 10 moves along the slope surface. Thus, the first slide member 10 also moves in a prescribed direction. Accordingly, the first slide member 10 can be moved with a simple structure.

The embodiments of the invention have been described above. However, the invention is not limited to the above description. Those skilled in the art can suitably modify the above embodiments, and such modifications are also encompassed within the scope of the invention as long as they include the features of the invention. For instance, the shape, dimension, material, and layout of various components in e.g. the remote control device 10 are not limited to those illustrated, but can be suitably modified.

Furthermore, various components in the above embodiments can be combined with each other as long as technically feasible. Such combinations are also encompassed within the scope of the invention as long as they include the features of the invention.

What is claimed is:

1. A remote control device for remotely controlling a toilet device, the remote control device comprising:

a casing forming a contour of the remote control device;

a power generation device housed in the casing and being capable of generating power by being pressed;

a plurality of buttons provided on a surface of the casing and each configured to be independently depressable relative to the one or more other buttons and to activate a respective function of the toilet device; and a link mechanism configured to move so as to press the power generation device when each of the buttons is pressed, the buttons being supported on the casing by an elastic member so that, when one of the buttons is pressed to cause motion of the link mechanism, another of the buttons not pressed is not affected by the motion of the link mechanism.

2. The device according to claim 1, further comprising:

a plurality of pushing parts, each of the pushing parts provided on a respective one of the buttons and configured to push the link mechanism; and a plurality of receptacles provided on the link mechanism and each configured to engage with a corresponding one of the pushing parts, wherein, when one of the buttons is pushed, the pushing part of the pushed one of the buttons pushes the receptacle, thereby moving the link mechanism.

3. The device according to claim 2, wherein:

each of the pushing parts is shaped like a protrusion, each of the receptacles includes a depression configured to engage with one of the pushing parts, and when one of the pushing parts engages with one of the depressions, the other pushing parts do not engage with the other depressions.

4. The device according to claim 2, wherein:

the pushing part includes a first protruding part extending toward the receptacle, the receptacle includes a second protruding part extending opposite to the first protruding part, and a first slope surface and a second slope surface are formed opposite to each other on opposed surfaces of the first protruding part and the second protruding part.

5. The device according to claim 1, wherein the power generation device includes an input part capable of self-power generation by being pressed by the link mechanism, and a stopper part configured to physically regulate a position of the link mechanism.

* * * * *